US005269522A

United States Patent [19]

Chagoll et al.

[11] Patent Number: 5,269,522

[45] Date of Patent: Dec. 14, 1993

[54] APPARATUS AND METHOD FOR PROMOTIONAL CONTESTS

[75] Inventors: Manuel E. Chagoll, Olathe, Kans.; Gordon Wheelwright, Buckinghamshire, United Kingdom

[73] Assignee: Graphic Technology, Inc., Olathe, Kans.

[21] Appl. No.: 763,326

[22] Filed: Sep. 20, 1991

[51] Int. Cl.[5] ..... A63F 9/24

[52] U.S. Cl. ..... 273/138 A; 273/139; 273/460

[58] Field of Search ..... 273/138 A, 138, 269, 273/237, 460, 139

[56] References Cited

U.S. PATENT DOCUMENTS

| | | | |
|---|---|---|---|
| 4,373,726 | 2/1983 | Churchill et al. | 273/138 A |
| 4,494,197 | 1/1985 | Troy et al. | 273/138 A |
| 4,573,954 | 3/1986 | Berger et al. | 273/138 A |
| 4,669,729 | 6/1987 | Solitt et al. | 273/138 A |
| 4,677,553 | 6/1987 | Roberts et al. | 273/269 |
| 4,703,933 | 11/1987 | Cahill et al. | 273/139 |
| 4,764,666 | 8/1988 | Bergeron | 273/138 A |
| 4,832,341 | 5/1989 | Muller et al. | 273/139 |
| 4,854,590 | 8/1989 | Jolliff et al. | 273/138 A |
| 4,982,346 | 1/1991 | Girouard et al. | 273/138 A |
| 5,007,641 | 4/1991 | Seidman | 273/138 X |

*Primary Examiner*—Jessica J. Harrison

*Attorney, Agent, or Firm*—Kokjer, Kircher, Bowman & Johnson

[57] ABSTRACT

A system and method are provided for promoting customer traffic. A promotional unit is provided having audio messages stored in its memory. At least one audio message is associated with a plurality, or range, of selected bar encoded indicia. The promotional unit audibly outputs the stored audio message associated with a particular indicia when that encoded indicia is scanned and decoded by the promotional unit. Means are provided for associating each audio message with a range of indicia identified by a starting indicia and an ending indicia. The system is adapted for editing the audio messages and providing corrective prompts for known fault conditions. The unit is adapted to employ musical audio messages and a plurality of scanner types.

13 Claims, 4 Drawing Sheets

APPARATUS AND METHOD FOR PROMOTIONAL CONTESTS

BACKGROUND OF THE INVENTION

This invention relates in general to a gaming device which is particularly useful for promoting the sale of goods or services. More particularly, a system and device are provided for electronically reading bar codes and audibly outputting a stored message linked with a given code.

Businesses commonly use various types of promotions to attract customers. Often, as part of these promotional campaigns, gaming tickets are distributed to customers offering a chance to win prizes or discounts on items to be purchased. These and other promotional devices offer incentives for customers to enter the store. Accordingly, "customer traffic" in the store is increased.

One such promotional device known to be used, and to which the present invention relates, includes a scanning device adapted to scan bar codes. The device is placed at the location where customer traffic is desired. An electronic memory is contained within the device for storing a predetermined set of codes and digitized, audio voice messages. Specifically, for each stored code in memory, a separate audio message is also stored in memory. Generally, the stored messages indicate whether a prize has been won.

Tickets are then made such that each ticket has one of the codes that is stored in memory printed on its face in bar encoded format. The tickets also generally include advertisements indicating the particular store offering the promotion and the prizes to be awarded to winners. The bar encoded tickets are sent to potential customers or given to customers at points of purchase. Recipients of a ticket may then go to the store and scan their ticket in the scanning device. The unit will decode the code scanned and retrieve from memory the audio message corresponding to that code. The message is audibly output through a built-in speaker.

The foregoing device has several drawbacks which the present invention overcomes. Particularly, the prior art device requires that for each number to be encoded, a message has to be stored. As a result, limited memory capacity necessitates that either stored audio messages remain short or only a small set of numbers to encode be chosen. It is often desirable for messages to explain the prizes won and further promote the business establishment which requires a longer message. When only a small set of numbers are to be encoded, the risk of counterfeiters determining the winning numbers is greatly increased.

Also, once the audio messages are assigned to a number and stored, editing the messages to be played or reconfiguring the number assignments is especially troublesome. Furthermore, the total length of audio messages is limited to about two and half minutes due to device constraints. Moreover, the audio messages are limited to voice messages. Musical capabilities are not available.

The prior art device has no capabilities to generate a database of numbers scanned or any means of determining who is scanning a ticket. Furthermore, scanning capabilities are limited to a slot scanner thereby necessitating that bar codes be on a flat paper-like object.

The present invention overcomes the drawbacks of the prior art and obtains the objects set forth below by providing a unique traffic promoting device that operates as a stand-alone audio message center. Programming of digitally stored data is achieved by use of a personal computer and computer software programs which are an integral part of this invention.

In accordance with the present invention, business persons, or others desiring to increase customer traffic, can compose audio messages or tones that are to be part of their promotion. Once composed, these messages are recorded onto audio tapes. The recorded messages are then digitized by a personal computer for storage into the computer's memory. Alternatively, inputting desired audio messages or tones for digitizing may be accomplished directly through a microphone without first recording the message.

The present invention allows the digitized audio messages to be easily edited using the editing features of the computer software. Particularly, "forward wind," "reverse wind," and "play" features are available. Accordingly, the programmer can select the portions of each message desired to be played as part of the promotion.

Once the messages are digitized, and edited if desired, they are stored into the memory of the computer. Each message is assigned a name known as its file name.

The software then allows the programmer to allocate each stored message to a range of numbers. The programmer accomplishes this simply by typing the starting number of the range, the ending number of the range, and the file name of the stored message to be associated with that range of numbers. Also, any single message can be assigned to more than one range of numbers. This feature is advantageous because a message need only be stored once, yet it can correspond to many numbers. In the prior art device, if a message was to be assigned to one hundred numbers, it had to be stored at one hundred memory locations. Furthermore, the present invention allows the ranges to be easily changed. This is advantageous because it allows a business to easily change its percentage of winners.

The audio messages stored in the personal computer's memory are ultimately stored on Electrically Programmable Read Only Memory (EPROM) devices. EPROMs are computer chips which are located on a memory board. The memory board, complete with encoded EPROMS, is what is actually located in the promotional unit of the present invention.

Before programming the EPROMs with the digitized audio messages and their corresponding range or ranges of numbers, EPROM Image Files are created automatically by the software to ensure that each EPROM to be used on the memory board is correctly programmed with all messages. As some messages will undoubtedly span more than one EPROM, the EPROM Image Files ensure that continuance of storage of messages, and continuance of message playback during use occurs without interruption when a message spans more than one EPROM. The software measures the length of time of the total of the messages and indicates to the programmer the number of EPROMs and EPROM size to be used.

An EPROM programming device is then plugged into the serial port of the personal computer. The EPROM programming device contains the memory board with the appropriate number and size of EPROMs or individual EPROMS. The EPROMs are programmed and the memory board, complete with programmed EPROMs, is placed in the gaming unit.

Each number that has been associated with a message is encoded into its bar code format. Each bar encoded number is then placed on a ticket. Preferably, each ticket contains only one bar code. Alternatively, the bar codes can be placed on other surfaces, such as labels on goods to be sold at a store. The present invention is adapted to use a variety of optical scanner types for scanning the bar encoded numbers. The objects containing the bar codes are then distributed to consumers.

While the current invention utilizes bar codes as the means of automatic data entry, other machine readable technology (e.g. magnetic stripe, optical character recognition, etc.) may be employed as alternative means of automatic data entry.

A promotional unit in accordance with the present invention is placed at the point where customer traffic is desired. Consumers having one of the bar encoded objects may use the unit to scan the bar code to see if they have won a prize. The circuitry within the unit decodes a scanned bar code, retrieves the message stored in the EPROM memory board that corresponds to the decoded number, and audibly outputs the message through either a built-in, or optional external speaker.

Another feature of the present invention allows a database to be compiled of those who have participated in the promotional campaign. One way this is accomplished is by distributing bar encoded gaming tickets to known addresses. Records are kept so it is known what number was sent to each address. The memory within the promotional unit may also have the ability to remember and record all numbers scanned. The promotional unit is serially connected to a personal computer, the stored, scanned numbers are sent to the computer, and a list of all of the numbers scanned is generated by the personal computer and stored in the computer's memory. This list of scanned numbers is then married with the list of those who were sent gaming tickets. Accordingly, information regarding who has participated in the promotion is obtained. In this manner, trending information can be gathered on consumers.

It is one object of the present invention to provide a store traffic promoting device adapted to associate a stored audio message with a plurality of numbers while storing that message only once.

It is another object of the present invention to provide a store traffic promoting device adapted to output audible tones in the form of music and jingles.

It is still another object of the present invention to provide an audio message center capable of playing longer messages than were available in the prior art.

A further object of the present invention to provide an audio message center wherein the audio messages are easier to edit when changes are desired.

Yet another object of the present invention is to simplify the process of converting analog tape recordings to digital EPROM memory through the use of a personal computer such that a minimum skill level will be required in an operator to manage this procedure.

Another object of the present invention to provide a promotional device which is more easily and efficiently prepared for use than has previously been available.

And another object of the invention is to provide an audio message center for scanning bar encoded numerals placed on a variety of types of objects.

Other and further objects of the invention, together with the features of novelty appurtenant thereto, will appear in the course of the following description.

DESCRIPTION OF THE DRAWINGS

In the accompanying drawings, which form a part of the specification and are to be read in conjunction therewith, and in which like reference numerals are used to indicate like parts in the various views.

DETAILED DESCRIPTION OF THE INVENTION

Figure 1:
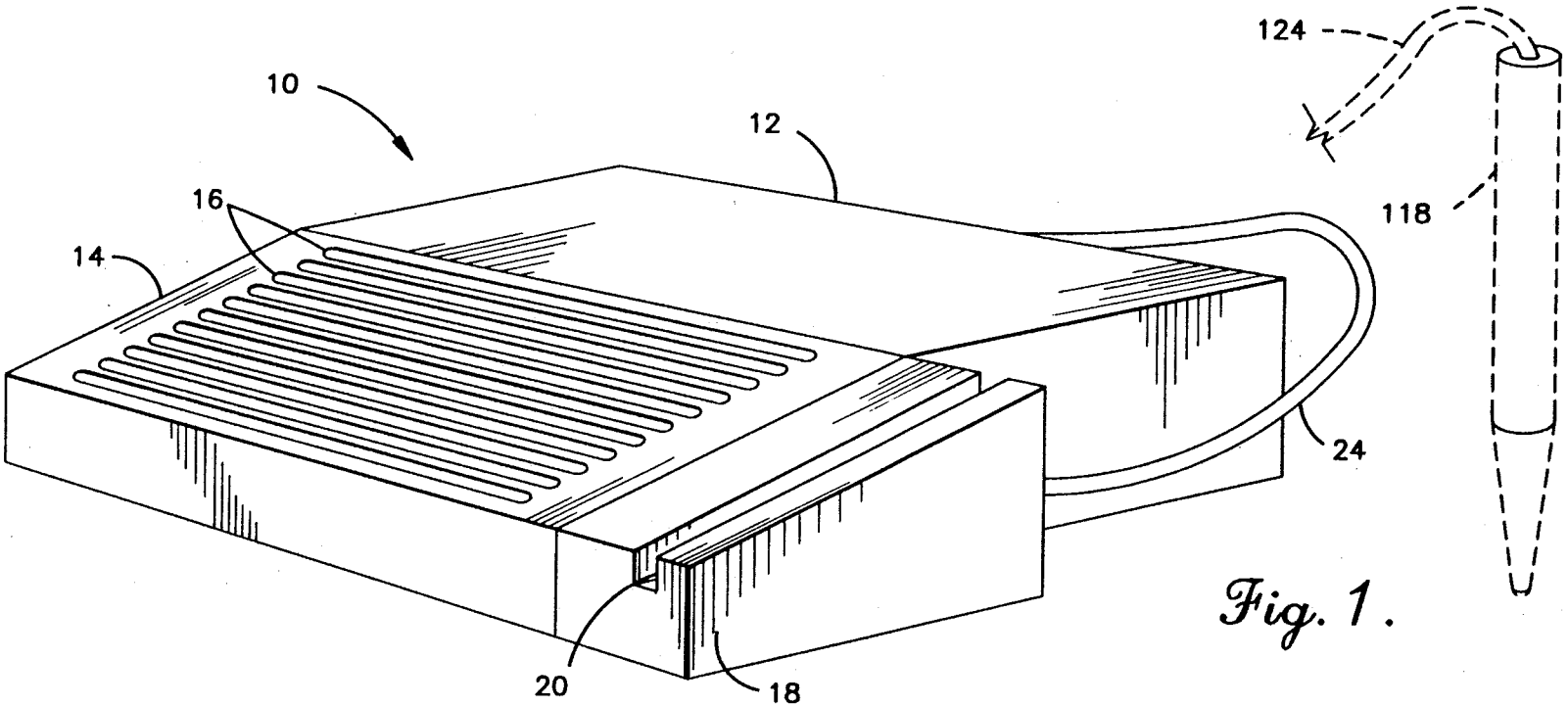
FIG. 1 is a perspective view of a preferred gaming unit embodying the present invention.

As seen in FIG. 1, the gaming unit of the present invention is generally denoted by numeral 10. The device has a case 12 with a front face 14.

Front face 14 contains openings 16 extending inwardly to the interior of case 12. Openings 16 permit audible tones output from unit 10 to be generally directionally projected to the user of unit 10. Front face 14 is preferably angled from the horizontal plane to enhance projection of the audio tones to the user of unit 10.

An optical scanner 18 having a slot 20 for optically reading bar codes is connected by cord 24 to scanner socket 26 (See FIG. 2) at the rear of unit 10. Optical scanner 18 is shown for illustrative purposes as a slot reader. However, the unit 10 is adapted to utilize various other types of optical scanners. As shown in broken lines, an optical scanner such as pen wand 118, connected to unit 10 by cord 124, may be utilized for reading bar codes. It is understood that it is an advantageous feature of the present invention to use various scanner types. Other types of bar code readers, such as laser scanners, CCD scanners, or other commonly used bar code scanners may be employed.

Figure 2:
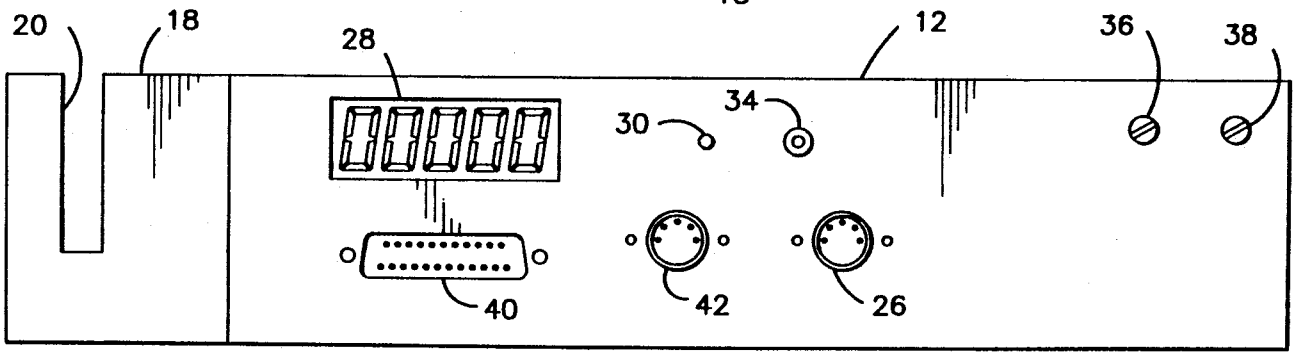
FIG. 2 is a rear elevational view of the gaming unit.

Referring now to FIG. 2, the rear of unit 10 is shown. A counter 28 increments one unit each time a bar code is read. A preferably recessed counter reset button 30 is also provided. External speaker socket 34 is available for plugging in external speaker means (not shown). Volume control 36 and tone control 38, preferably recessed, are also provided for adjusting the sound output from unit 10.

Serial data communications board 40, preferably an RS232C data port, is connected to a Central Processing Unit (CPU) board 48 inside unit 10. A power socket 42 is enlisted for providing AC (alternating current) power to unit 10. Scanner socket 26 is used to connect various types of scanning means 20 to unit 10.

Figure 3:
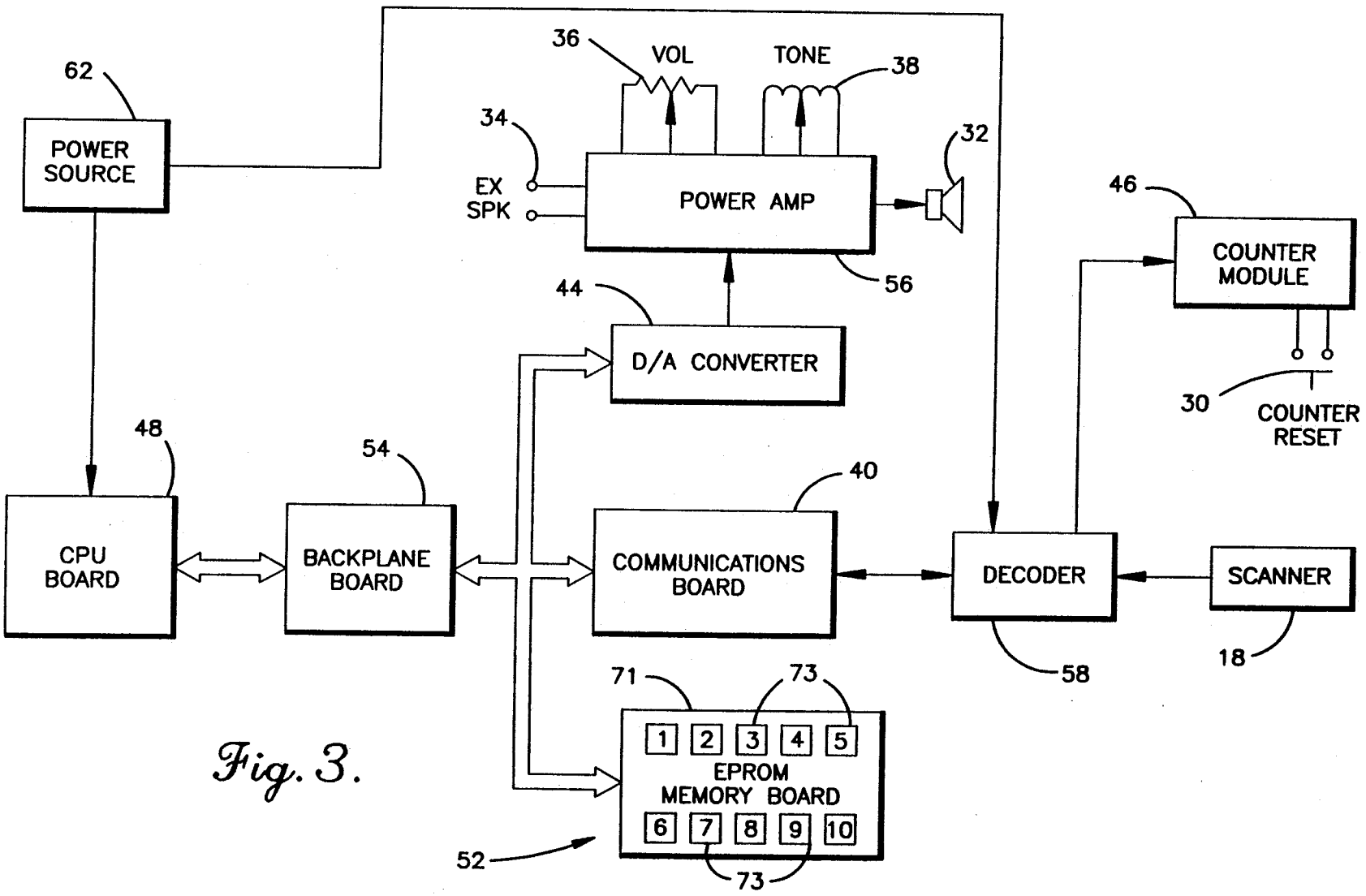
FIG. 3 is a block diagram of the circuitry in the gaming unit.

In FIG. 3, a block diagram of the preferred circuit configuration of unit 10 of the present invention is shown. Digital to analog converter 44, communications board 40, and memory board 52 are all bidirectionally connected with each other and each is also bidirectionally connected to CPU board 48 through backplane board 54. Backplane board 54 is an adapter which allows a plurality of circuit elements to be connected to one port of CPU board 48.

Digital to analog converter 44 is connected to power amplifier circuit 56, which is in turn connected to internal speaker 32. Power amplifier circuit 56 can be one of many commonly used amplifier circuits. Power amplifier circuit 56 includes volume control means 36, tone control means 38, and external speaker socket 34. A switch (not shown) automatically disconnects internal speaker 32 when an external speaker is plugged into external speaker socket 34.

EPROM Memory board 73 holds a maximum of ten (10) 256K or 512K EPROMs 73. Each 256K EPROM will store approximately 15 seconds of recorded audio messages and each 512K EPROM will store approximately 30 seconds of recorded messages. It should be understood that additional memory can be utilized if greater memory space is needed.

Communications board 40 is connected to decoder 58. As shown, optical scanning means 20 used in accordance with the present invention are connected to decoder 58. Counter module 46, having counter reset 30 is also connected to decoder 58.

A power source 62 is connected to CPU board 48 and decoder 58. Power source 62 may supply AC power commonly obtained from a wall outlet to unit 10 through power socket 42 (FIG. 2). Alternatively, power source 62 may be a rechargeable battery pack which supplies DC (direct current) power to unit 10.

Figure 4:
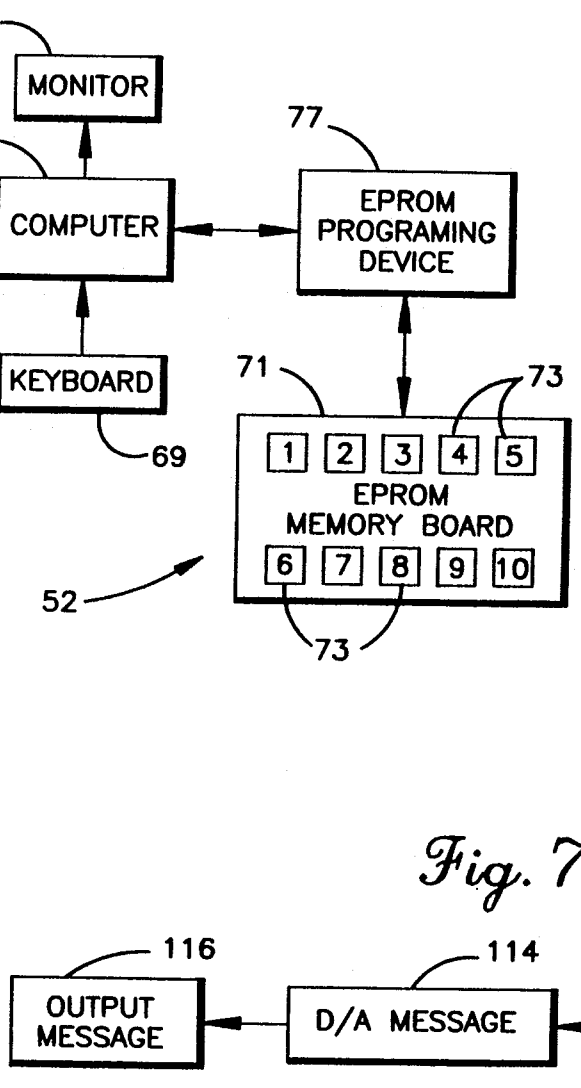
FIG. 4 is a block diagram of the computer system utilized in preparation of the gaming unit.
Figure 5:
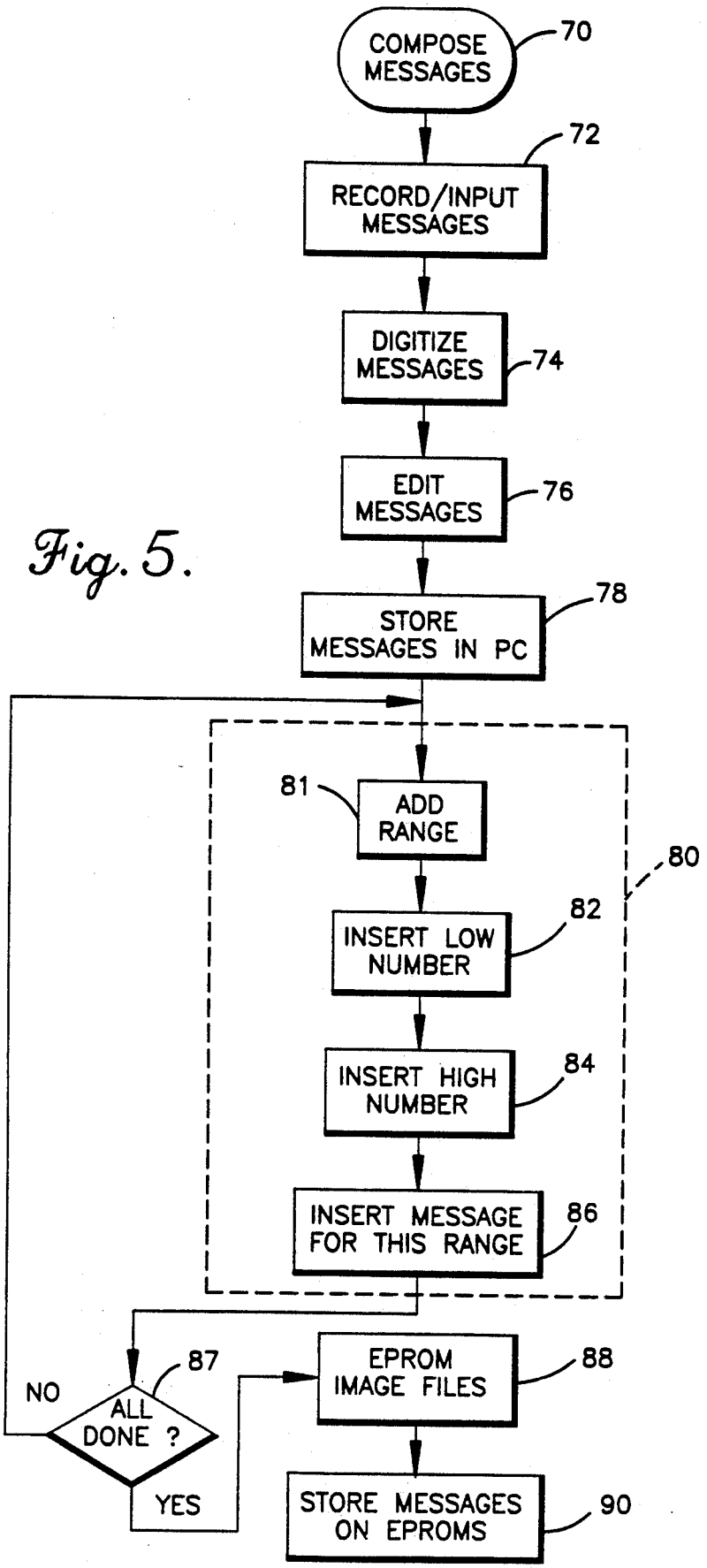
FIG. 5 is a flowchart of the computer program used to prepare the gaming unit.

Referring now to FIGS. 4 and 5, the preferred embodiment for preparing unit 10 for use is set forth. FIG. 4 shows a block diagram of the preferred computer system used to prepare unit 10 for use. FIG. 5 shows a preferred flow chart of the computer program used to prepare unit 10.

As seen in FIG. 4, microphone input 63 and tape input 65 are connected to preamplifier and filter circuit 64 which is in turn connected to analog to digital converter 66. Analog to digital converter 66 is connected to computer 67 which has a monitor 68 and a keyboard 69. EPROM memory board 71, with up to 10 EPROMs 73, is also connected to computer 67. As shown in FIG. 3, once EPROMS 73 are programmed, EPROM memory board 71 is inserted into unit 10.

As shown in FIG. 5, the present invention provides computer software for carrying out the preparation procedures of unit 10. The computer software is preferably DOS based and compatible with IBM or compatible computers. It is understood that the software could be reprogrammed to utilize other types of computers and operating systems.

Initially, at reference numeral 70, audio messages or tones desired to be used in a promotional campaign are composed. Preferably, a desired number of audio messages corresponding to winning prizes are composed and one losing message is composed. Also, a message indicating that a test is being conducted and that no prizes will be awarded during the test and a message indicating that an error has occurred and prompting the user of unit 10 to try scanning the bar code again are preferably composed. Each message may comprise any type of tone including vocal tones, musical tones or a combination of vocal and musical tones. The audio messages are in the form of analog (i.e., continuous time) signals.

Once composed, each audio messages is input to the computer system of FIG. 4. As indicated by reference numeral 72 of FIG. 5, each audio message may be recorded onto audio tape, such as cassette tape, and input to the computer system through tape input 65. Digital recording can also be accomplished via direct microphone input. Each message inputted into the system passes through preamplifier and filter circuit 64 and enters analog to digital converter 66.

At reference numeral 74, each message is digitized from its analog signal state to a digital signal. A high sampling rate during digitization, preferably of at least 20.5 kilobits per second, allows the digitized messages to retain a high degree of fidelity. Accordingly, a high degree of accuracy exists between the signals as input and the signals as later output. Accordingly, even complex musical compositions, or jingles, can be input and digitized without losing sound quality.

If desired, each digitized message may then be edited using the software editing features indicated by numeral 76. "Forward Wind," "Reverse Wind," and "Play" options allow the programmer to select portions of each digitized message to be stored and later played when unit 10 is operated. "Forward Wind" and "Reverse Wind" functions allow rapid movement either direction through digitized messages. Start and stop points of each message may be selected for storage into memory 75 of computer 67. The byte counter on monitor 68 of computer 67 provides a visual marker for locating desired start and stop points of digitized messages. The "Play" function permits audio playback of selected message portions. If no editing is necessary, step 76 can be skipped. Playback of audio messages during editing occurs through speaker means connected to a/d converter 66.

Each message is then stored in memory 75 of computer 67 as indicated by reference numeral 78 of FIG. 5. A message file name is assigned to each message stored in computer memory 75. While it is understood that various types of messages can be used, and each can be named appropriately, for illustrative purposes, the messages preferably stored include the following: 1) a plurality of winning PRIZE messages, labeled with file names such as WIN1, WIN2, etc.,, each indicating that a particular prize has been won; 2) one losing message, labeled with the file name DEFAULT, indicating that no prize has been won; 3) one error message, assigned file name ERROR, and 4) one test message assigned file name TEST.

A typical ERROR message may be: "I DID NOT READ YOUR CODE, PLEASE TRY AGAIN." A typical message to be played when TEST is activated may be: "THIS IS A SYSTEM TEST, NO PRIZES WILL BE AWARDED FROM THE FOLLOWING MESSAGES." When the TEST is played, it will be immediately followed by all other messages stored in the system, commencing with the ERROR message. Each message played is separated by a short beeptone to indicate the finish and start of each individual message.

Utilizing keyboard 69, the programmer associates each stored message with desired numbers as indicated by reference numeral 80 of FIG. 5. In addition to the ERROR and TEST messages, the computer software allows a further ninety-nine (99) ranges of numbers to be allocated to messages. Accordingly, in the preferred embodiment, a maximum of ninety-eight (98) ranges of numbers are available for winning PRIZE messages. This would leave only one (1) range left to be allocated to the DEFAULT message. The software may be modified to utilize an expanded number of ranges; as many as any specific application might require.

The numbers available for allocation are all numbers between 0 and 9,999,999,999 inclusively. Preferably, number 9,999,999,999 is allocated to the ERROR message leaving 0 to 9,999,999,998 available for number ranges associated with other messages. It should be understood that while the present invention preferably utilizes only numbers for allocating to messages, the software could be modified to use other identifying indicia such as letters or symbols that are capable of being encoded into bar code format. Furthermore, the range of numbers may also be expanded as dictated by application requirements.

Associating desired ranges of numbers to each message is carried out by selecting sets of numbers and then assigning one message file to each set selected. The software generates a menu on computer monitor 68 which allows the programmer to add ranges of numbers, as indicated by reference numeral 81.

When the "add range" function is selected, the software prompts the programmer on computer monitor 68 to enter one low number representing the START of the number range being added, as indicated by reference numeral 82. The programmer enters the desired low number with keyboard 69. Next, at reference numeral 84, software prompts the programmer on monitor 68 to enter one high number representing the END of the number range being added. The programmer enters the desired high number using keyboard 69.

The software then prompts the programmer to enter a message filename for the range of numbers added. Again, using keyboard 69, the programmer types in the filename of the message desired to be associated with the range created. This allows one stored message to be associated with each and every one of the numbers in the added range. The software also automatically assigns each range added a range identification number.

The range numbers must always increase for each successive range and the START number must always be higher than the previous range END number. In this manner, each message may be assigned to more than one range of numbers, but any single number is associated with only one message.

In the preferred embodiment, all prize winning messages are first allocated to desired ranges. The TEST message is then preferably allocated to number 9,999,999,999. This is accomplished in the same manner by adding a range with a START number of 9,999,999,999 and an END number of 9,999,999,999. The DEFAULT message is used for all range numbers which are not allocated to prize messages or the TEST message. After all ranges are programmed into the system, the DEFAULT file automatically "fills in" all other ranges that have not been allocated to a message. This eliminates the need to program numerous losing messages and adds further security to the total system.

The ERROR message is not allocated to a range of numbers. Rather, in the preferred embodiment, logic within unit 10 causes the test message to be played during use of unit 10 when a bar code is not properly scanned. For example, the error message will respond in the following circumstances: when optical scanner 18 and decoder 58 did not correctly read and decode the bar code which was scanned or did not recognize all characters of the scanned code; when the scanned bar code represents one or more non-numeric codes; when the numeric bar code length is greater than 9,999,999,999; when a scanned bar code does not have the proper key code (described below).

Entered data can be edited (not shown) using the "Change," "Delete," and "Insert Data" commands. The "Change" command allows previously entered data to be altered. The "Insert Data" command is especially useful when it is desired to insert an additional range somewhere amidst previously entered ranges. These editing commands are also used when an error occurs. For instance, the system as preferably programmed will not accept errors where Range Numbers are duplicated, or where the END Number of a Range is not equal to, or greater than, the START of a Range Number.

The software also provides capabilities for printing the current set-up and saving it on a floppy disk if desired. The set-up is saved to a Control File of the actual Job name being prepared. The Job name is set by the programmer. If a previous set-up has already been saved under a chosen file name, before proceeding to save the newly created data, the system will warn the programmer that previously saved data will be erased. If saved to an external floppy disk, the set-up can be reloaded to the system later if desired.

After all messages have been assigned to desired number ranges as determined at reference numeral 87 of FIG. 5, EPROM Image Files are automatically generated as indicated by reference numeral 88. This is accomplished by selecting an appropriate menu command.

EPROM Image Files insure that each EPROM 73 to be used on memory board 71 is correctly programmed with all messages. Since the audio messages are ultimately stored on EPROMs 73 in "back-to-back" relation, some messages will almost surely span more than one EPROM 73. This program routine insures continuance of storage and playback of a message without interruption when a message spans more than one EPROM 73. The system checks that all message files are present and correctly defined under the JOB name being used. If any file is missing, or incorrectly labeled, the system will not continue with generation of the EPROM Image Files. Prompts to help the programmer find errors appear on computer monitor 68 advising the programmer of any missing file names.

Upon completion of generation of the EPROM Image Files, computer monitor 68 will display the quantity of EPROMs needed and the appropriate EPROM size (256k or 512k) needed for storing all of the set-up data including audio messages and number range information.

Upon successful generation of the EPROM Image Files, all set-up data is stored onto EPROMs 73 using computer 67 and EPROM programming device 77 as indicated by reference numeral 90 of FIG. 5. This is carried out by selecting the appropriate menu command in accordance with this invention.

The software of the present invention allows a variety of file formats to be used and the programmer is directed by computer monitor 68 to choose the appropriate file format. Next, the type of EPROM to be used is selected from a variety of choices programmed into the software.

When programming EPROMs 73, the system will request the file name from which to read. The system will have assigned the message filenames an extension of .Uxx, where xx is the number of the EPROM, from one (1) to ten (10), as indicated on EPROM memory board 71 of FIG. 4. Each EPROM 73 can be programmed individually or all EPROMs can be programmed in succession without operator intervention.

If EPROM programming device 77 is not properly connected to computer 67, a prompt on monitor 68 will advise accordingly. Prompts to aid the programmer are the result of preprogramming the software for analyzing known faults and storing potential solutions to those faults in memory 75. The system will automatically self-check that each EPROM 73 is in working condition and is blank. If an EPROM 73 is not blank, a screen prompt on monitor 68 will advise to replace the non-blank EPROM 73 with a new EPROM 73 or to erase the existing device. Upon completion of EPROM programming, the system will carry out a program routine which checks and advises that each EPROM is correctly programmed. EPROM memory board 71, complete with encoded EPROMs 73, is then properly wired into unit 10 as indicated in FIG. 3.

Figure 6:
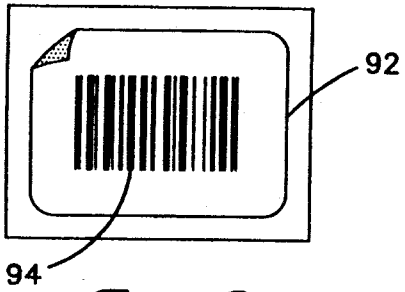
FIG. 6 shows a bar code placed on an adhesive label.

Referring now to FIG. 6, bar encoded adhesive labels 92 are printed. One bar code label for each number in a winning prize range is preferably printed. Understandably, other quantities of each winning number could be printed. However, if a greater number of winning tickets is desired, it is preferable to merely increase the size of one or more winning ranges using the software editing features. This allows winning odds to be automatically computed. Preferably, a "test" ticket with bar encoded numeral 9,999,999,999 is also printed. A desired number of tickets bearing bar encoded numerals that are not within a winning prize range are also printed. These tickets may correspond to the DEFAULT message.

The process of encoding numerals into their bar code format is carried out by any commercially available bar encoding device. It should be understood that label 92 is merely for illustrative purposes. Bar codes may be placed directly on goods or packaging as desired in any conventional manner.

One or more units 10 are then placed in a desired location in a store or wherever customer traffic is desired. Unit 10 is equipped with the preferred type of optical scanner and an external speaker if desired. It should be understood that a plurality of units 10 could be set up for placement at various locations. Preferably, some time prior to public use, bar code number 9,999,999,999 is scanned to test the device. At this time, volume control 36 and tone control 38 are initially set. Counter display 28, incremented to one (1) during the test, is reset using counter reset 30.

The bar encoded tickets or goods bearing the bar encoded numerals are distributed to the public in any conventional manner. For instance, tickets may be sent by mail to consumers along with promotional advertising or with bar codes printed in the advertising. Alternatively, tickets may be given out at points of purchase or customers may purchase goods bearing one of the bar encoded labels.

Figure 7:
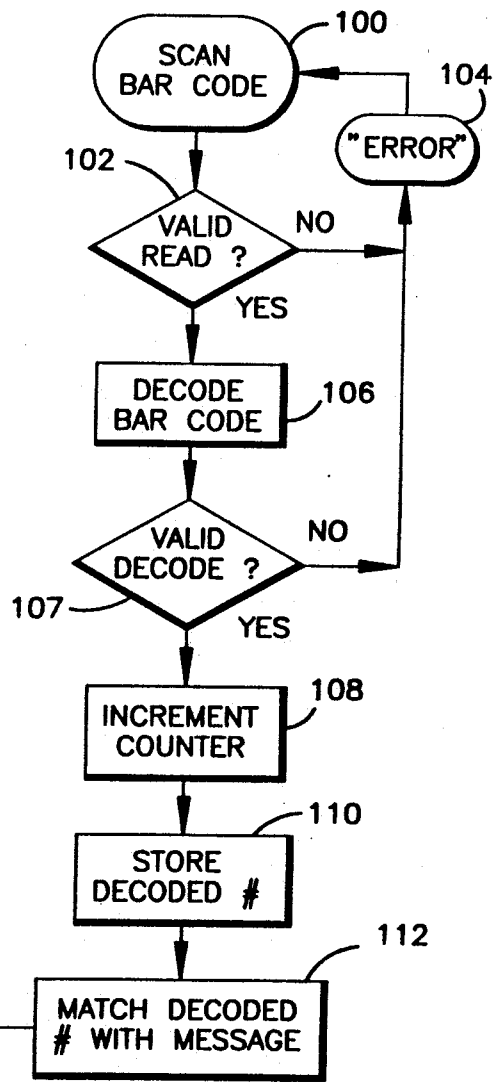
FIG. 7 is a flowchart illustrating the gaming unit in use.

Referring to FIG. 7, preferred operation of the unit is described.

The holder of an article bearing a bar encoded ticket as part of a particular promotional campaign is optically scanned as indicated by reference numeral 100. Logic within unit 10 determines if the scanned bar code has been validly read by optical scanner 18 as indicated by reference numeral 102. If not, the ERROR message will be played as indicated by reference numeral 104. Alternatively, the system can be set so that upon an invalidly scanned bar code, the system will generate a "beep tone" indicating a faulty read.

As indicated by reference numeral 106, decoder 58 decodes a validly scanned bar code. As logically determined at reference numeral 107, if decoder 58 is unable to decode the scanned bar code, the error message will be played as indicated by reference numeral 104. If decoder 58 properly decodes the scanned bar code, counter module 46, and correspondingly counter display 28, are incremented as indicated by reference numeral 108. The decoded number is stored in EPROM memory 73 as indicated by reference numeral 110.

Logic means within CPU 48 of unit 10 match the decoded number with the message assigned to the number range into which the scanned number falls as indicated by reference numeral 112. This matching can be accomplished in a variety of ways utilizing known comparison methods. For example, the decoded number could be compared with all numbers from 0 to 9,999,999,999 to find a match.

Alternatively, it should be understood that if precise determination of the scanned number is not desired, but only what number range it falls in, the logic of CPU 48 could be programmed to compare the scanned, decoded number with the START and END numbers of each range until a match is found. The following provides a representative example:

> Is the scanned number greater than or equal to START number of winning prize range one? If "no, " play DEFAULT. If "yes," is scanned number less than or equal to END number of winning prize range one? If "yes," play message associated with range one? If "no," is scanned number greater than or equal to START number of winning prize range two?...

It is easily seen that such a sequence could be carried out until the number range associated with the scanned number is reached.

Once the decoded number is matched with its number range and corresponding audio message, that audio message is retrieved from EPROM memory board 71 and sent to digital to analog convertor 44 as indicated by reference numeral 114. Here, the digital audio signal is converted to an analog signal (i.e., a continuous time signal). The retrieved message is then audibly output through the speaker means of unit 10 as indicated by reference numeral 116. Upon completion of the message, unit 10 is immediately ready to scan another bar code.

In an alternative embodiment of the present invention, records preferably in the form of a computer database are kept regarding who was sent a particular bar encoded number. For instance, records may be kept that ticket number 8327 was sent to a certain person, address, or phone number. Then, when ticket number 8327 is scanned, the number 8327 could be stored in EPROM memory 73 of unit 10. At various times, computer 67 may be connected to serial communications port 40 of unit 10.

Alternatively, computer 67 may be continuously connected to unit 10. At the end of each audio message played, the corresponding scanned number is automatically sent to memory 75 of computer 67.

Using commercial software, such as "CHIT CHAT" as manufactured by Sage of the United Kingdom, all numbers could be stored in memory of unit 10 are "dumped" or loaded into memory 75 of computer 67. A list of all of the numbers scanned is generated and married with the records kept identifying to whom each number was sent. Accordingly, a database is generated generally indicating who has and has not participated in the promotion. In this way, consumer trending information is established which can be consulted for future promotions and aids in formulating advertising campaigns.

In another embodiment of the present invention, the bar encoded numerals include a "key code" such that a scanned card must have the chosen key code to be valid. For example, the first number of the bar code may be designated as the "key" number. If, for example, the number is not a three (3), the card is deemed a counterfeit and the error message is played.

Alternatively, a message other than an error message indicating that a particular scanned code is not valid with a particular promotion could be played when the "key code" is invalid. For example, in a three week promotion utilizing three waves of advertising, first distributed bar codes may have a first key number, second distributed bar codes may have a second key number, and third distributed bar codes may have a third key number. If each distribution corresponds to one week of the promotion, and it is desired that a code be valid only for its associated week, messages could be programmed accordingly.

Each number allocated to a key number reduces the number of numbers available for allocating to messages. Furthermore, to prevent frustration of the ranging feature of the present invention, the key code is preferably prefixed to the beginning of the bar code or appended to the end of the bar code and the software is programmed accordingly.

From the foregoing it will be seen that this invention is one well adapted to attain all ends and objects hereinabove set forth together with the other advantages which are obvious and which are inherent to the structure and procedures.

It will be understood that certain features and subcombinations are of utility and may be employed without reference to other features and subcombinations. This is contemplated by and is within the scope of the claims.

Since it is possible that embodiments may be made of the invention without departing from the spirit and scope thereof, it is to be understood that all matter herein set forth or shown in the accompanying drawings is to be interpreted as illustrative and not in a limiting sense.

Having described my invention, I claim:

1. A gaming system comprising: control means comprising:

means for storing a plurality of messages;

means for generating a plurality of symbols;

means for grouping said symbols into symbol ranges, each symbol range having a start symbol and an end symbol;

means for storing said symbol ranges; and means for associating at least one of said messages with a selected range of symbols, wherein different ranges are associated with different messages and wherein each symbol of a selected range is associated with one message;

the system further comprising means for generating indicia representative of each symbol, said indicia being located on an article and said article being available to a player, said indicia being in machine readable form, means for reading said indicia and for transmitting said read indicia to said control means, said control means also comprising means for determining the symbol range which contains the symbol represented by the read indicia, and means for outputting the corresponding associated message to a player based upon said determine range, said message indicating to a player game status.

2. A gaming system as in claim 1 wherein said symbols are numbers.

3. A gaming system as in claim 1 wherein said symbols are letters.

4. A gaming system as in claim 1 wherein at least one of said plurality of messages comprises an audio message.

5. A gaming system as in claim 1 further comprising a counter which increments one unit each time a symbol is properly read.

6. A gaming system as in claim 1 wherein at least one of said plurality of messages indicates that a prize has been won.

7. A gaming system as in claim 1 further comprising means for allocating by default a preselected message of said plurality of messages with each generated symbol that is not associated with a message.

8. A gaming system as in claim 7 wherein said preselected message is a losing message for indicating game status.

9. A gaming system as in claim 1 wherein said control means further comprises means for detecting an error during operation of a gaming system, and wherein one of said plurality of messages indicates that an error has occurred and said output means outputs said error message to the player when said control means detects an error.

10. A gaming system as in claim 1 wherein each said symbol includes a common key code associated with a particular promotion for preventing unauthorized symbols from accessing said stored messages.

11. A gaming system as in claim 1 further comprising means for editing said stored messages.

12. A gaming system as in claim 1 further comprising means to generate image data of said messages and associated symbols to ensure proper storage to said storage means.

13. A gaming device as in claim 1 further comprising means for storing pre-determined fault conditions in said storage means, means for storing potential causes and solutions for said fault conditions in said storage means, and logic means including means for determining said fault conditions, means to retrieve the correct measures preprogrammed into memory for the appropriate fault, and mean to route said corrective measures to a player.

* * * * *